US009779709B2

(12) United States Patent
Linn

(10) Patent No.: US 9,779,709 B2
(45) Date of Patent: Oct. 3, 2017

(54) POLYPHONIC MULTI-DIMENSIONAL CONTROLLER WITH SENSOR HAVING FORCE-SENSING POTENTIOMETERS

(71) Applicant: Roger Linn, Berkeley, CA (US)

(72) Inventor: Roger Linn, Berkeley, CA (US)

( * ) Notice: Subject to any disclaimer, the term of this patent is extended or adjusted under 35 U.S.C. 154(b) by 248 days.

(21) Appl. No.: 14/810,379

(22) Filed: Jul. 27, 2015

(65) Prior Publication Data

US 2016/0124559 A1 May 5, 2016

Related U.S. Application Data

(60) Provisional application No. 62/075,414, filed on Nov. 5, 2014.

(51) Int. Cl.

| | |
|---|---|
| ***G10H 1/00*** | (2006.01) |
| ***G10H 1/055*** | (2006.01) |
| ***G10H 3/14*** | (2006.01) |

(52) U.S. Cl.

CPC ..... *G10H 1/0066* (2013.01); *G10H 1/0558* (2013.01); *G10H 3/146* (2013.01); *G10H 2220/161* (2013.01); *G10H 2220/241* (2013.01); *G10H 2220/295* (2013.01)

(58) Field of Classification Search

CPC .... G10H 1/0066; G10H 1/0558; G10H 3/146; G10H 2220/161; G10H 2220/241; G10H 2220/295; G10H 2220/525

USPC ..... 84/734

See application file for complete search history.

(56) References Cited

U.S. PATENT DOCUMENTS

| | | | | |
|---|---|---|---|---|
| 4,353,552 | A * | 10/1982 | Pepper, Jr. | A63F 13/06 273/148 B |
| 4,810,992 | A * | 3/1989 | Eventoff | G06F 3/045 338/114 |
| 4,852,443 | A * | 8/1989 | Duncan | G10H 1/0551 200/600 |
| 6,703,552 | B2 * | 3/2004 | Haken | G10H 1/0555 84/423 R |
| 7,408,108 | B2 * | 8/2008 | Ludwig | G10H 1/00 84/718 |
| 7,902,450 | B2 * | 3/2011 | Haken | G10H 1/34 84/600 |
| 8,266,971 | B1 * | 9/2012 | Jones | G01L 1/146 73/862.046 |
| 8,934,088 | B2 * | 1/2015 | Lambert | G05G 9/04796 356/139.01 |
| 9,130,572 | B2 * | 9/2015 | Tanaka | H03K 17/9647 |

(Continued)

*Primary Examiner* — David Warren
*Assistant Examiner* — Christina Schreiber
(74) *Attorney, Agent, or Firm* — Clifton Leon Anderson

(57) ABSTRACT

A polyphonic multi-dimensional controller (PMC) provides for independently expressing multiple concurrently sounding musical notes. The PMC includes rows and columns of force-sensing potentiometers (FSPs) that define an array of single-touch zones (STZs). Using a z-axis switch configuration, touches are detected and the forces associated with the touches are measured. For STZs for which a touch is detected, a fine x position and a fine y position are determined respectively using an x-axis switch configuration and a y-axis switch configuration. By repeatedly scanning the STZs, the x-axis position, the y-axis position, and the z-axis force can be tracked and translated into 3-axis note expression data. The PMC is multi-touch so that the 3-axis note expression data can be polyphonic.

14 Claims, 9 Drawing Sheets

(56) References Cited

U.S. PATENT DOCUMENTS

| | | | | |
|---|---|---|---|---|
| 9,390,697 | B2 * | 7/2016 | Takegawa | G10H 1/32 |
| 9,459,160 | B2 * | 10/2016 | Shaw | G01L 1/146 |
| 2002/0134223 | A1 * | 9/2002 | Wesley | G10H 1/0066 84/719 |
| 2006/0123982 | A1 * | 6/2006 | Christensen | G10H 1/0066 84/723 |
| 2007/0198926 | A1 * | 8/2007 | Joguet | G06F 3/041 715/702 |
| 2007/0240560 | A1 * | 10/2007 | Plamondon | G10H 1/34 84/744 |
| 2008/0028920 | A1 * | 2/2008 | Sullivan | G10H 1/342 84/722 |
| 2011/0167992 | A1 * | 7/2011 | Eventoff | G10H 1/0558 84/723 |
| 2012/0166947 | A1 * | 6/2012 | Miwa | G10H 1/0066 715/716 |
| 2012/0174735 | A1 * | 7/2012 | Little | G10H 1/0008 84/613 |
| 2012/0247308 | A1 * | 10/2012 | Tsai | G06F 3/0421 84/658 |
| 2013/0152768 | A1 * | 6/2013 | Rapp | G10H 3/125 84/634 |
| 2013/0340598 | A1 * | 12/2013 | Marquez | G10H 1/0558 84/730 |
| 2014/0083279 | A1 * | 3/2014 | Little | G10H 1/0008 84/609 |
| 2015/0262559 | A1 * | 9/2015 | Beck | G10H 1/0016 84/645 |
| 2016/0078854 | A1 * | 3/2016 | Eventoff | G10H 3/00 84/734 |
| 2016/0124559 | A1 * | 5/2016 | Linn | G10H 1/0066 345/173 |
| 2016/0307553 | A1 * | 10/2016 | Yu | G10H 3/146 |
| 2016/0314774 | A1 * | 10/2016 | Borman | G10H 3/146 |

* cited by examiner

POLYPHONIC MULTI-DIMENSIONAL CONTROLLER WITH SENSOR HAVING FORCE-SENSING POTENTIOMETERS

BACKGROUND

Electronic instruments, including hardware-based and software-based musical instruments, offer an unlimited palette of expressive sounds. However, a performer's ability to access and control these sounds is limited by the music performance controllers through which the performer interfaces with the electronic instruments.

Many music performance controllers provide piano-style keys as note triggers. While well-suited for triggering percussive and plucked sounds, such controllers provide limited or no facility for controlling the expression of sounds once they are triggered. For example, common to all acoustic wind and bowed-string instruments is the performer's ability to continuously control each note's volume, pitch (e.g., as in a vibrato or a slide from one note to another), and timbre (bite pressure on the reed, or bow angle or bow position). It is often desired to have similar control of volume, pitch, and timbre when emulating wind and bowed-string instruments as well as when generating other emulative and non-emulative (e.g., synthetic) sounds.

Many piano-type controllers include additional controls, e.g., pitch-bend wheels, modulation wheels, foot pedals, breath controllers and pressure and/or aftertouch, to control the expression of a sound. With the exception of pressure/aftertouch, these ancillary controllers can be awkward to use as they are separated from the finger that determines which note to play. In other words, to modulate the volume, pitch, and timbre of a sound requires at least one hand, foot or mouth in addition to the hand used to select a note to be played. For example, one could control volume with pressure (channel or key), pitch with a pitch-bend wheel, and timbre with a foot pedal. However, it can be very awkward to control the expression of sound using two or three separate controllers.

Another problem with requiring more than one hand to play a note expressively is that the techniques that work (more or less well) for one note do not scale to two or more notes. For example, when three notes are sounding, it is not usually possible to modulate the volume, pitch or timbre of one of the notes without affecting the others. For another example, one cannot normally use a pitch wheel to slide from an A-minor (ACE) chord to a C-major (CEG) chord since the A-C slide is three semitones and the C-E slide is four semitones. One cannot normally apply a vibrato to a melody note without applying it to a concurrently sounding accompaniment chord.

In order to control expression polyphonically, that is, independently control the expression of more than one note at a time, the finger that plays the note can also control expression. For polyphonic multi-dimensional note expression, the finger that plays the note should control multiple (two or more) axes of expression for that note.

One approach to polyphonic multi-dimensional note expression is to provide a multi-dimensional sensor for each of plural note triggers. However, the large number of multi-dimensional sensors required for such a controller to have a wide (several octaves) note range can be costly. Furthermore, controllers that use a separate sensor for each note are not well-suited to controlling continuous slides from one note to another.

Another approach to polyphonic multi-dimensional note expression is to use a continuous multi-touch sensor to detect and track finger position. In order to provide the precision required for musical expression, many positions on the multi-touch sensor would have to be resolved, e.g., by scanning them sequentially. This scanning would have to be repeated frequently enough to track motion. Also, a touch would cover many positions that would have to be resolved to provide sufficiently fine tracking for musical expression purposes; accordingly, some sort of centroid determination or other mathematical processing would be required to identify a single position for each touch at any given time.

While such processing is readily performed on smartphone and tablet touchscreens, the cost can become excessive when scaled to surfaces sufficiently large for two-handed playing of a musical instrument. Furthermore, most touchscreens do not sense finger pressure, which is important for controlling a musical note's volume over time, and those few touchscreens that do sense pressure do so with insufficient pressure range for musical purposes.

Accordingly, what is needed is a cost-effective music performance controller with polyphonic multi-dimensional note expression.

DETAILED DESCRIPTION

In accordance with the present invention, a polyphonic multi-dimensional controller includes a sensor with sensing layers, each including force-sensing potentiometers (FSPs). One layer includes "row" FSPs extending in an x-direction, while the other layer includes "column" FSPs extending in a y-direction. The row FSPs serve as wipers for the column FSPs and vice versa. Collectively the FSPs define single touch zones (STZs), each STZ intersecting a row FSP and intersecting a column FSP. When an STZ surface is touched, the respective row FSP and the respective column FSP contact each other to make an electrical connection that can be used to detect the presence of the touch, the force of the touch, and the x and, in some embodiments, the y position of the touch.

At most one touch can be detected within an STZ at any given time. Even if a performer manages to touch an STZ at two different positions, only one touch is detected (hence the "single" in "single-touch zone"). The STZs are scanned to determine which ones, if any, are touched. Fine position, e.g., in x and y dimensions, need only be determined for the STZs that are touched. There is no need to scan individual fine positions or to identify fine positions using centroid analysis or the like. As a result, processing requirements and associated manufacturing costs are greatly reduced.

Figure 1:
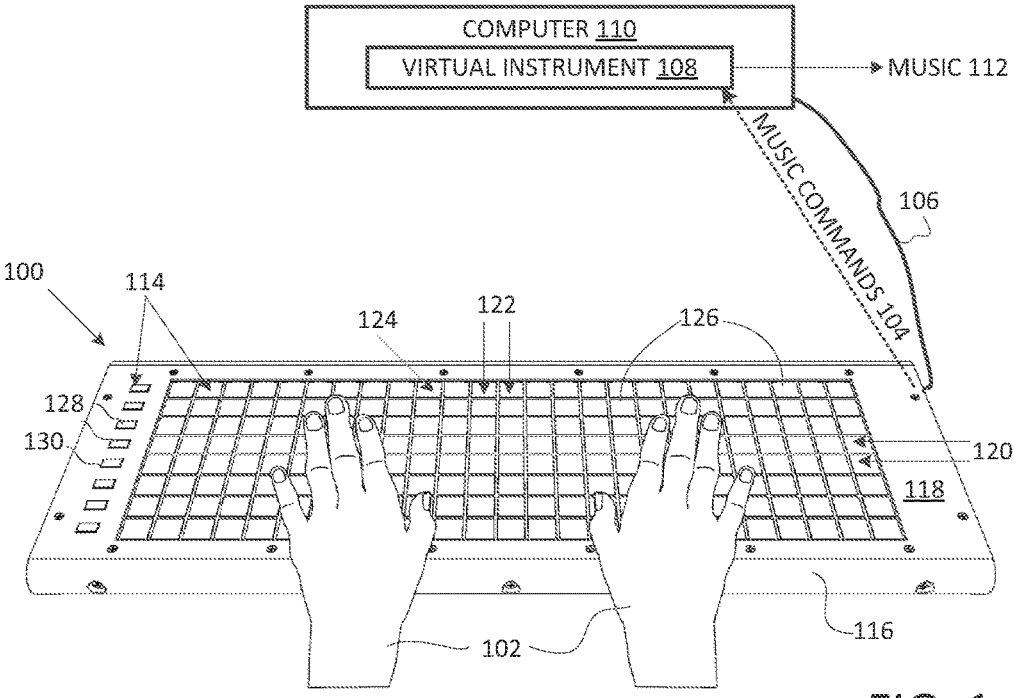
FIG. 1 is a schematic diagram of a polyphonic multi-dimensional controller (PMC) being used to control an electronic music instrument, in this case, a software instrument running on a computer.

A polyphonic multi-dimensional controller (PMC) 100 is shown, in FIG. 1, being operated by a musician 102 (represented by hands) so as to send music commands 104 via a cable 106 to a virtual instrument 108, running on a computer 110. Virtual instrument 108 causes computer 110 to output music 112 in response to music commands 104. Alternatively, PMC 100 can be used to control a hardware electronic instrument, such as a MIDI (Musical Instrument Digital Interface) sound module.

Herein, a "polyphonic multi-dimensional controller" or "PMC" is a controller designed for the performance of music that provides for polyphonic multi-axis note expression. That is, at least two dimensions of expression can be controlled independently per note independently for at least two notes. For example, the following four parameters could be varied independently of each other: the volume of note A, the pitch of note A, the volume of note B, and the pitch of note B. For a three-axis example, the following six parameters could be controlled independently: the volume of note A, the pitch of note A, the timbre of note A, the volume of note B, the pitch of note B, and the timbre of note B.

PMC 100 includes a tactile membrane 114, a body 116, and a top panel 118; top panel 118 clamps tactile membrane 114 in position within body 116. Tactile membrane 114 is divided into tactile rows 120 and tactile columns 122. Rows 120 and columns 122 intersect to define a grid 124 of tactile cells 126. In addition, tactile membrane 114 includes buttons 128, which protrude through respective apertures 130 in top panel 118.

PMC 100 is highly configurable so that different assignments of notes to cells and of performance gestures to musical parameters can be employed. In one default configuration, cells are assigned to musical notes. The notes assigned to cells increase chromatically from left to right within an row. By default, the notes increase by musical fourths interval (five musical semitones) from front to rear within a column, but any interval may be configured. Depending on the instrument being controlled, striking a cell harder or softer can affect the loudness of a triggered sound.

Likewise, the loudness of a sustaining sound can be adjusted by varying the z-axis force applied to the cell. Touches that move left and/or right within a row can cause the pitch of a sustaining note to change. Movement of a touch left and or right across column boundaries within a row can cause the pitch to slide continuously from note to note. Wiggling a touch within a cell can effect a vibrato. Front-rear (y-axis) movement of a touch within a cell can be used to adjust timbre. If multiple cells are touched concurrently, each note produced can be controlled independently of the others as expected of a polyphonic multi-dimensional controller.

The ability to continuously vary the values of three musical parameters, such as loudness, pitch, and timbre, for each of plural notes independently is referred to herein as "polyphonic 3-axis note expression". The means by which PMC 100 implements polyphonic 3-axis note expression is described below. In some embodiments, polyphonic 2-axis note expression is implemented, e.g., by omitting either x-axis or y-axis control.

PMC 100 is connected to computer 110 via a single cable 106, e.g., a USB cable. Music commands 104, in the form of Musical Instrument Digital Interface (MIDI) data, are communicated from PMC 100 to computer 110 via cable 106. PMC 100 provides a channel-per-note mode in which notes are distributed over plural MIDI channels round-robin style. In effect, each note has its own channel and all the parameters available to that channel are then, in effect, associated with a single note. Thus, polyphonic three-axis note expression is readily achieved as common monophonic controls can be used to express each note. Alternative embodiments use more advanced music command protocols, such as Open Sound Control (OSC), that provide for polyphonic three-axis per-note expression.

In addition, power for operating PMC 100 is provided from computer 110 to PMC 100 via cable 106. An advantage of PMC 100 over some PMCs is that its power requirements are low enough that it can be powered using USB 2.0 bus power. In fact, much of the power consumed by PMC 100 is due to the LEDs rather than the force and position sensing which only requires about 185 milliamps. As a result, only one cable is required for PMC 100 (despite the presence of LEDs which consume most of the power), as opposed to two or more for PMCs requiring a separate power supply. In some embodiments, a power supply input and MIDI (Music Instrument Digital Interface) 5/180° DIN (Deutsches Institut für Normung, the German national standards organization) output are provided so that PMC 100 can be used to control electronic instruments and interfaces employing standard MIDI connectors. In alternative embodiments, other power and data communications solutions are employed.

Figure 2:
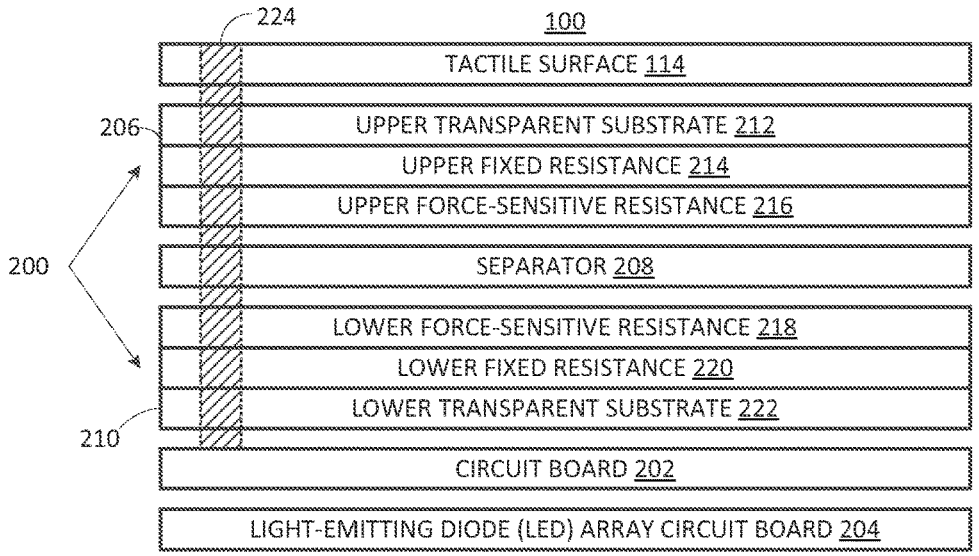
FIG. 2 is a block diagram representing layers included in the PMC of FIG. 1.

Tactile membrane 114 is the top layer of a multi-layer structure including a sensor 200, a controller circuit board 202, and a light-emitting diode (LED) circuit board 204, as shown in FIG. 2. Sensor 200 includes an upper sensing layer 206, a separator 208, and a lower sensing layer 210. Upper sensing layer 206 includes an upper transparent substrate 212, an upper fixed resistance sublayer 214, and an upper force-sensitive resistance sublayer 216. Lower sensing layer 210 includes a lower force-sensitive resistance sublayer 218, a lower fixed resistance sublayer 220, and a lower transparent substrate 222.

Substrate sublayers 212 and 222 can be sheets of transparent mylar. Fixed-resistance sublayers 214 and 220 can be fixed-resistance ink printed in a pattern on the respective substrate sublayers. Force-sensitive resistance sublayers 216 and 218 can be force-sensitive resistive ink printed onto the respective fixed-resistance sublayers 214 and 220.

Figure 3:
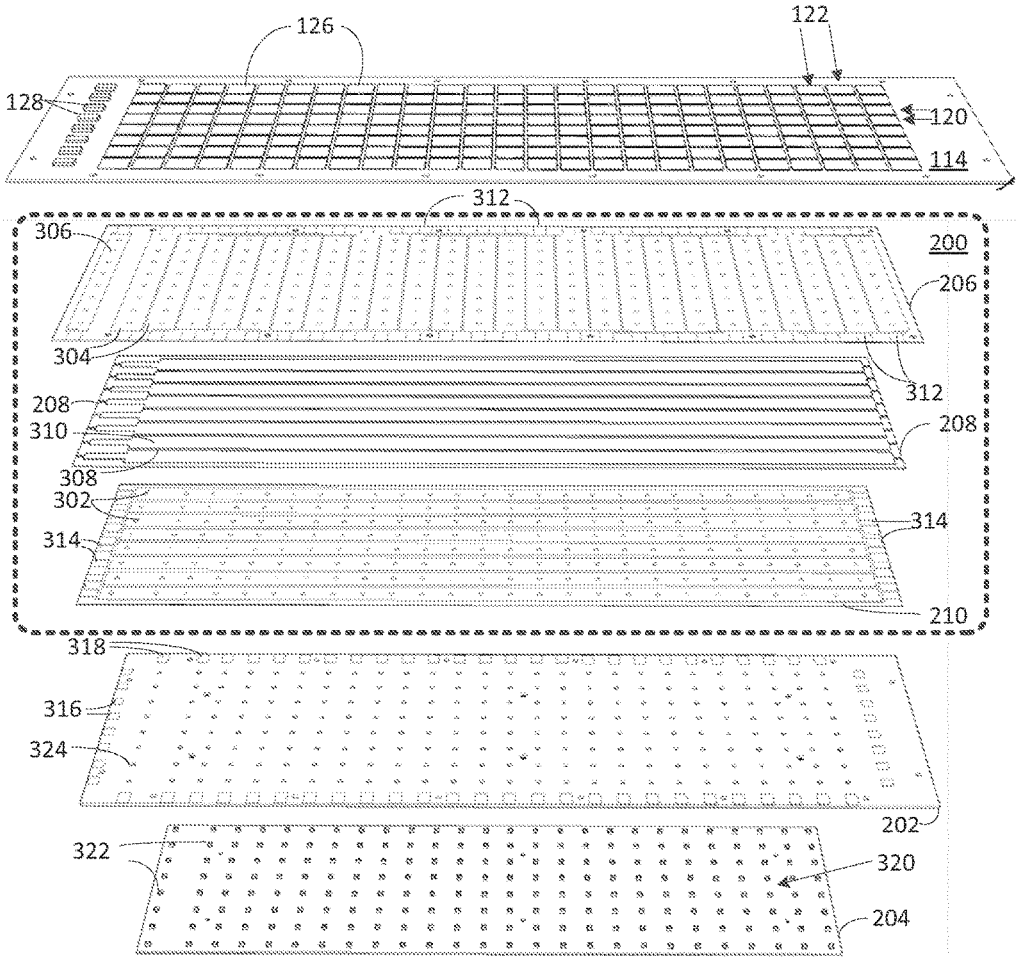
FIG. 3 is an exploded perspective view showing layers of the PMC of FIG. 1.

Resistive sublayers 218 and 220 of lower sensing layer 210 are printed in rows to define respective row FSPs 302 (FIG. 3); while the resistive sublayers 214 and 216 (FIG. 2) of upper sensing layer 206 are printed in columns to form respective column FSPs 304 (FIG. 3). When PMC 100 is assembled, row FSPs 302 and column FSPs 304 are vertically aligned respectively with rows 120 and columns 122 of tactile membrane 114. For each FSP 302 and 304, the respective fixed resistance sublayers 214, 220 provide the potentiometer aspect for measure position, while the respective force-sensitive resistance sublayers 216, 218 provides the force sensing. An alternative embodiment omits fixed-resistance sublayers, relying of force-sensing resistance sublayers for both force sensing and position sensing. However, the inclusion of the fixed-resistance sublayers provide for greater accuracy and range in pressure sensing.

Touching a cell 126 causes the corresponding row FSP 302 and the corresponding column FSP 304 to connect electrically within the corresponding STZ 224 (FIG. 2). Thus, each cell 126 serves as the tactile top surface of a respective STZ 224. Note that upper sensing layer 206 includes a column FSP 306 dedicated to buttons 128. The row FSP can determine the fine x-position of a touch within an STZ, while the column FSP can determine the fine y-position of a touch within an STZ.

Thus, the fine x and y positions of a touch can be determined from potentiometer readings in the touched STZ. In addition, z-axis force of the touch can be determined as the combined resistance through the FSR layers 216 and 218 in the touched STZ. This resistance decreases with the force of the touch. The velocity of an initial touch can be determined by differences in pressure taken over a short series of pressure measurements.

As noted above, cells 126 of tactile membrane 114, shown in FIG. 1, may be viewed as the tops of STZs 224, one of which is shown in FIG. 2. PMC 100 has 208 STZs, including 200 corresponding to cells 126, and eight corresponding to buttons 128. Each STZ 224 is a rectangular parallelepiped extending from the top surface of tactile membrane 114 through sensing layers 206 and 210 to the top of controller circuit board 202. In the absence of a touch, sensing layers 206 and 210 are spaced and electrically disconnected by separator 208. However, when a cell 126 is touched, upper sensing layer 206 and lower sensing layer 210 come into contact in the corresponding STZ 224. The contact can be detected, the force causing the contact can be measured electrically, and the location of the touch within the cell can be precisely determined using FSPs 302 and 304.

Separator 208 is a plastic frame in which longitudinally (x-dimension) extending ribs 308 define longitudinally extending apertures 310 that align with row FSPs 302 and tactile rows 120. In the absence of a touch, separator ribs 308 maintain separation and electrical isolation of sensing layers 206 and 210. When a cell 126 is touched, sensing layers 206 and 210 can contact through an aperture 310. Ribs 308 are, in effect, dead zones that prevent continuous tracking between cells of a column. On the other hand, elongated apertures 310 permit continuous tracking of touches moving between cells 126 of a tactile row 120. As a result, motion between cells in a row can be interpreted as continuous changes in pitch, while motion between cells in a column typically results in newly triggered notes. In an alternative embodiment, sensing layers are separated by spacer dots instead of the disclosed spacer.

Upper sensing layer 206 includes conductive pads 312 at the front and rear of each of column FSPs 304 and 306. Lower sensing layer 210 includes conductive pads 314 at the left and right ends of each of row FSPs 302. Conductive pads 312 and 314 are used to apply voltages or for reading voltages across rows 302 and columns 304 and 306, as explained below in connection with the description of controller circuit board 202.

Controller circuit board 202 has conductive pads 316 along its left and right sides. Conductive tape (not shown) is used to electrically connect pads 316 to respective pads 314 along the left and right sides of lower sensing layer 210. Circuit board 202 has conductive pads 318 along its front and rear sides. Conductive tape is used to electrically connect pads 318 to respective pads 312 along the front and rear sides of upper sensing layer 206. In an alternative embodiment, small flat flexible connectors are used instead of conductive tape. Connections on the sensing layers are forced together by the pressure of screws holding top panel 118 down.

Lower sensing layer 210 is longer than upper sensing layer 206 so that upper sensing layer 206 does not occlude the pads 316 on lower sensing layer 210. This facilitates making and breaking the connections with circuit board 202. Similarly, upper sensing layer 206 is wider than lower sensing layer 210 to make it easier to make and break the connections between circuit board 202 and upper sensing layer 206.

LED circuit board 204 includes an array 320 of RGB LEDs 322 (FIG. 3), which are used to provide a selection of colors. LEDs 322 are aligned with the centers of cells 126 so that cells 126 can be illuminated with a choice of colors. Holes 324 through controller circuit board 202, lower sensing layer 210, and upper sensing layer 206, allow light from LEDs 322 to reach cells 126.

Figure 4:
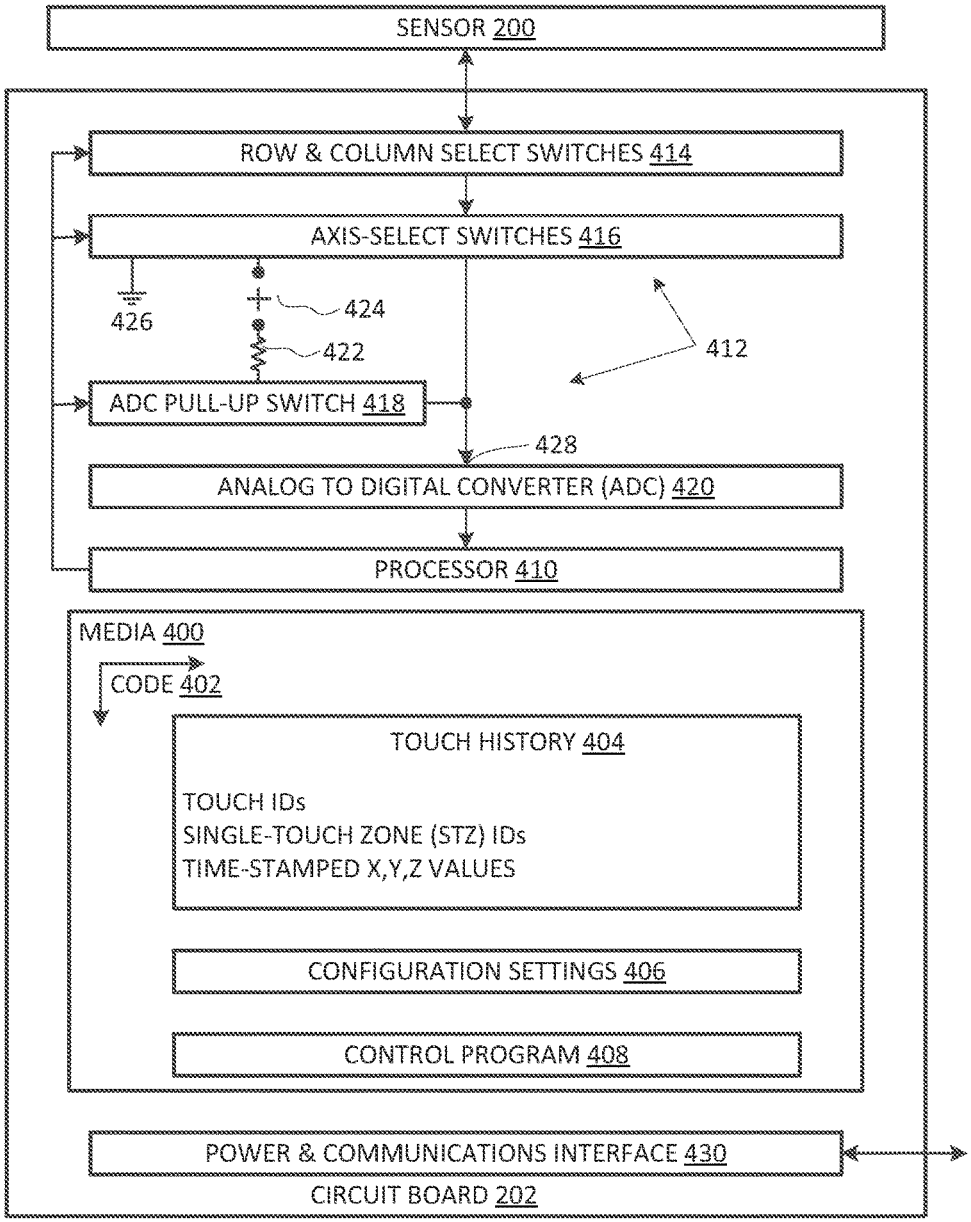
FIG. 4 is a block diagram of a circuit board assembly of the PMC of FIG. 1.

Sensor 200 is controlled and monitored by controller circuit board 202, as indicated in FIG. 4. Circuit board 202 includes media 400, which in turn includes non-volatile memory and volatile memory. Media 400 is encoded with code 402 including a touch history 404, configuration settings 406, and a computer-executable control program 408. Configuration settings 406 store data identifying such aspects of configuration such as transpose settings, keyboard split points, initial touch quantization, controller assignments, etc.

Touch history 404 stores time-stamped values for fine x position, fine y position, and z force. Typically, the last three sets of values for each touch are stored in touch history 404. Touch history 404 can be used to determine changes in touch data. For example, an increase in z-force can occur as a cell is being triggered; in such a case, the z-force change rate can be translated into velocity information to accompany a note-ON message. The velocity information may then, for example, be used to determine the initial volume of a newly triggered sound.

Touch history 404 is also used to distinguish initial touch detections versus continuation touch detections. When a touch is detected, it may either be the first time the touch is detected or the touch may have been detected previously. Initial touch detections are typically used to trigger new sounds, while continuation touch detections are typically used to modify a previously triggered sound without retriggering it.

If the previous scan indicated no touch for the cell for which a current touch is detected, this would suggest an initial touch as opposed to a continuation touch. However, a complication arises since a touch detected in a first cell may be detected later in a second cell due to a slide, e.g., between adjacent cells within a row. Therefore, fine x data may have to be considered to distinguish one touch followed by a separate touch from a sliding touch. For example, if the fine x history data indicates that a touch in an adjacent cell was near or approaching the boundary, then the current touch, depending on its fine x position, may be interpreted as a sliding continuation rather than a new touch. In addition, the touch history can determine when a non-detection represents a note-OFF event, a slide-off, or a null event.

So that touch history 404 can be used to distinguish initial and continuation touches and to determine rates of force change, a processor 410 of circuit board 202 time stamps and records in touch history 404 x, y, and z parameter values for the last three or more detections of each touch. When a new touch is detected, it is entered into touch history 404. An identity (Touch ID) for the touch is stored, along with an STZ ID for the STZ selected when the touch was first detected. The time-stamped original x, y, and z values are stored in association with the Touch ID and the STZ ID.

Upon subsequent detections of a touch, touch history 404 is updated by adding the new data. When the capacity available for a touch is reached, older data for a touch may be deleted to make room for more recent data. When a touch is released, the data for the touch can be deleted from touch history 404 to make room for data representing a new touch. For PMC 100, up to approximately 50 touches can be tracked at once; other embodiments have different limits on the number of touches that can be tracked concurrently.

Controller circuit board 202 includes processor 410 for executing instructions of control program 408 in accordance with configuration settings 406. Control program 408 controls high-speed analog switches 412, which provide for high-speed (compared to mechanical switches) routing of analog signals. Switches 412 include row and column select switches 414, axis select switches 416, and an analog-to-digital converter (ADC) pull-up switch 418. ADC pull-up switch 418 selectively couples an input 428 of an analog-to-digital converter (ADC) 420 to a pull-up resistor 422, which is coupled to power-level voltage 424. Row and column select switches 414 selectively couple individual STZs to axis-select switches 416. Axis select switches 416 selectively couple a selected STZ to power 424, ground 426, or a signal input 428 to ADC 420.

In operation, two-hundred eight (208) STZs are repeatedly scanned for touches. Scanning proceeds one STZ at a time in a raster progression from the front left across each row ending at the rear right STZ. Touch detections result in touch data to be stored in touch history 404, touch data is converted to music commands transmitted via power and communications interface 430. Interface 430, which can be a USB 2.0 or higher interface, can receive power for PMC 100. The operation of switches 412 during the scanning is described below with reference to, for expository purposes, 3×3 arrays of STZs.

Figure 5A:
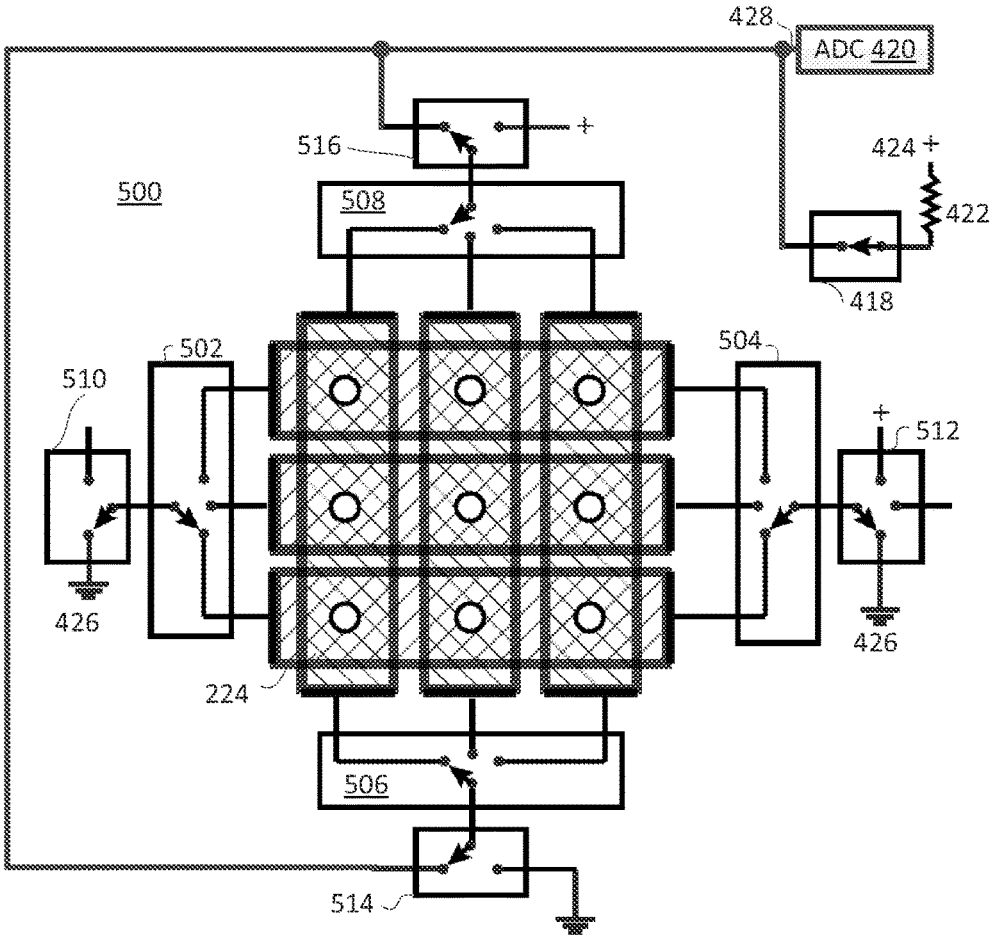
FIG. 5A is a schematic diagram showing switches in a z-axis configuration for the PMC of FIG. 1.

FIG. 5A represents high-speed analog switches 412 in a z-axis configuration 500. Row and column select switches 414 include a left-row select switch 502, a right-row select switch 504, a front-column select switch 506, and a rear-column select switch 508. Left-row selector switch 502 and right-row selector switch 504 are operated in tandem so that they select (opposite ends of) the same row FSP 302. Front-column select switch 506 and rear-column select switch 508 are operated in tandem so that they select (opposite ends of) the same column FSP 304 or 306. As shown in FIG. 5A, left-row select switch 502 and right-row select switch 504 have both selected the first (front-most) row, the front-column select switch 506 and the rear-column select switch 508 have both selected the left-most column FSP. Thus, the front left STZ is selected as it intersects both the selected row FSP 302 and the selected column FSP 304.

Whereas row and column select switches 414 are used to select among STZs 224, axis-select switches 416 and ADC pull-up switch 418 are used to select which axis is to be evaluated. When configured as shown in FIG. 5A, axis-select switches 416 and ADC pull-up switch 418 select the z-axis for detecting touches, measuring force (corresponding to pressure), and the rate of force change (corresponding to velocity).

Axis-select switches 416 include a left-row axis-select switch 510, a right-row axis-select switch 512, a front-column axis-select switch 514, and a rear-column axis-select switch 516. In the z-axis configuration of FIG. 5A, left-row axis-select switch 510 and right-row axis-select switch 512 couple the ends of the selected row to ground 426. Front-column axis-select switch 514 and rear column axis-select switch 516 couple the ends of the selected column FSP to the input 428 of ADC 420. ADC pull-up switch 418 couples ADC input 428 to a power level 424 via pull-up resistor 422. The z-axis configuration is used to detect touches and non-touches for all STZs in every scan; for touched STZs, the z-axis configuration is also used to detect pressure and velocity (as a function of sequential pressure readings).

Figure 5B:
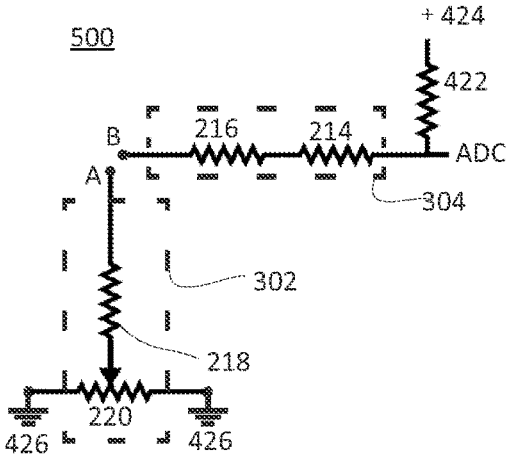
FIG. 5B is a circuit equivalent diagram for the z-axis configuration of FIG. 5A.

FIG. 5B presents a circuit equivalent to z-axis configuration 500. In the absence of a touch, nodes A (of FSP 302) and B (of FSP 304) do not contact each other and are not electrically connected. Accordingly, there is no current through pull-up resistor 422 and therefore no voltage drop between power 424 and ADC input 428. A voltage at the ADC input 428 at the power level is read as a no-touch detection.

When there is a touch at the selected STZ, nodes A and B are in contact and are electrically connected. This establishes a current path from power (+) 424 through pull-up resistor 422, fixed resistance 214, force-sensing resistance 216, force-sensing resistance 218, and a voltage-divided lower fixed resistance 220 to ground 426. As a result of this current, there is a voltage drop at pull-up resistor 422, so that the voltage at ADC input 428 is lower than power (+). This lower voltage is interpreted as a detection of a touch and the amount that the voltage is lower than power is used to determine the force of the touch.

The voltage associated with a touch can be sampled repeatedly (two, three or more times) to determine a rate of change of force. This rate of change can be interpreted as a velocity, e.g., of the initial touch. A corresponding velocity command can be sent, e.g., with a note-on command to an electronic sound generator, which might, for example, adjust the volume of a sound based on the velocity. Thus, the z-axis configuration is sufficient to: 1) detect touches; 2) determine the force associated with each touch; and 3) determine the rate of change of force associated with each touch. In effect, the z-axis configuration permits polyphonic key pressure, that is, polyphonic 1-axis note expression. To attain polyphonic 3-axis note expression, precise tracking along x and y axes is employed.

When a touch is detected, processor 410 knows which row is selected and which column is selected. The selected column corresponds to the gross x position of the touch. The selected row corresponds to the gross y position of the touch. In other words, the array position of the selected STZ is known, so the detected touch is within the area of the corresponding STZ. However, to provide for slides, vibratos, precise control of timbre, and other articulations, x-position and y-position must be tracked with greater precision.

Some alternative embodiments incorporate diodes to address n-key rollover that can apply to matrix switches. Due to n-key rollover, in the illustrated embodiment, one cannot play a cell that exists at the fourth corner of a rectangle for which three cells are already pressed. The illustrated embodiments provide alternative cells for most notes, so the rectangular cell combination is easily avoided.

Figure 6A:
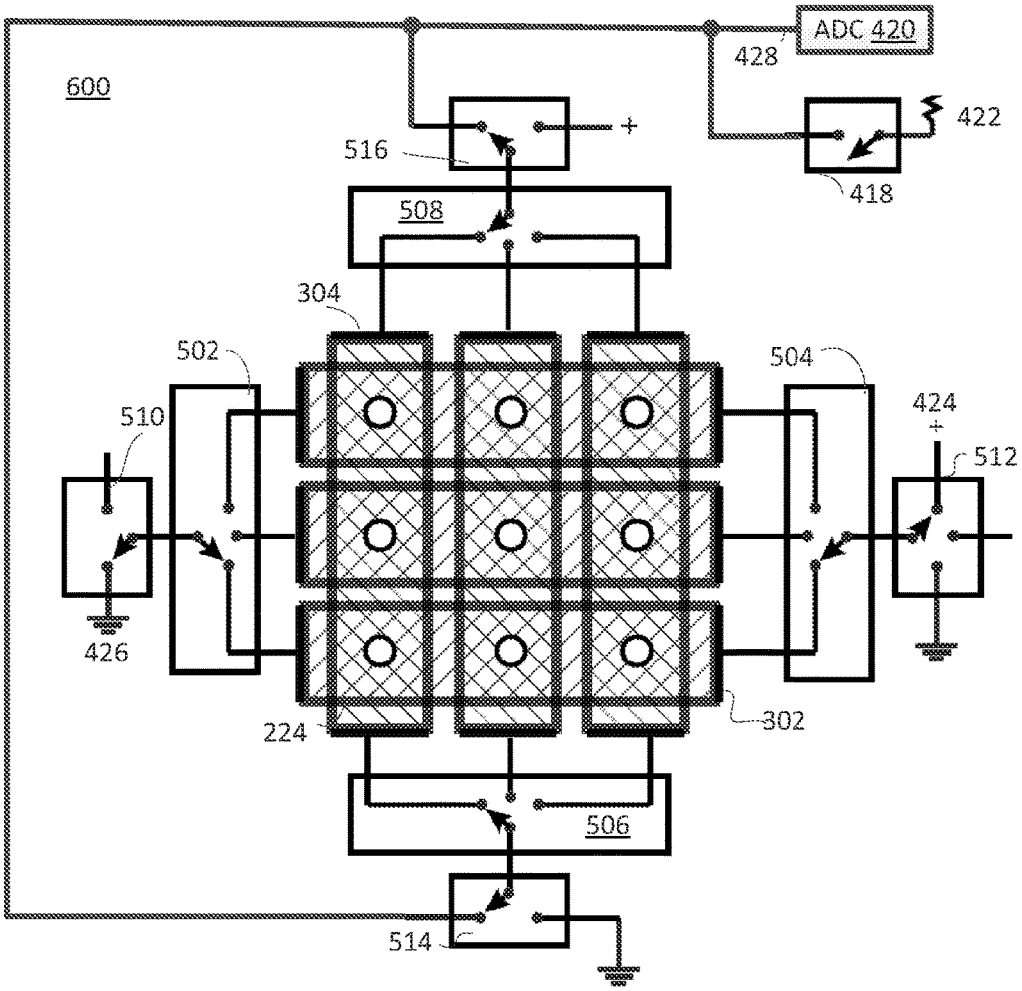
FIG. 6A is a schematic diagram showing switches in an x-axis configuration for the PMC of FIG. 1.

FIG. 6A shows an x-axis configuration 600 used for precisely determining the x-position of a touch associated with a selected STZ. As in the z-axis configuration of FIG. 5A, it is the lower left STZ that is selected by STZ select switches 414. Also, as in the z-axis configuration, the front and rear column axis-select switches 506 and 508 respectively couple the ends of the selected column FSP 304 to ADC input 428. However, the x-axis configuration differs from the z-axis configuration in that the right-row axis-select switch 512 couples the right end of the selected row FSP 302 to power 424 and the left-row axis-select switch 510 couples the left end of the selected row FSP 302 to ground 426. As a result, there is a current-inducing a voltage differential across the selected row FSP 302. In addition, ADC input 428 is decoupled from pull-up resistor 422.

Figure 6B:
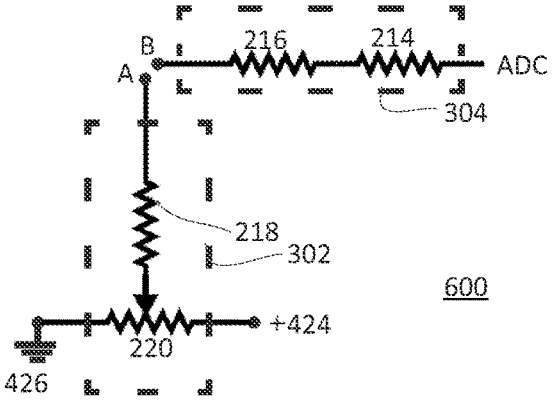
FIG. 6B is a circuit equivalent diagram for the x-axis configuration of FIG. 6A.

The circuit equivalent for x-axis configuration 600 is shown in FIG. 6B. There is a current through lower fixed resistance 220, but no current through force-sensing resistances 216 and 218 or though upper fixed resistance 214. The location of the touch for the selected STZ defines a voltage divider for the selected row FSP 302. Since there is no voltage drop along resistances 214, 216, and 218, the voltage read by ADC 420 is the voltage at the voltage divider. This voltage serves as a precise indicator of the x position of the touch for the selected STZ.

Note that the same sensor element, e.g., the front row FSP, is used to measure the fine x position for all STZs in the row. If there are two or more touches on the same row, the fine position of each touch will be read independently of the others as the respective STZs are selected. Likewise, all STZs of a column share the same column FSP 304 for determining the fine y position of a touch. The fact that all STZs of a row share the same sensor element for determining fine x position and all STZs of a column share the same sensor element for determining y position contributes to the simplicity and cost-effectiveness of PMC 100.

Figure 7A:
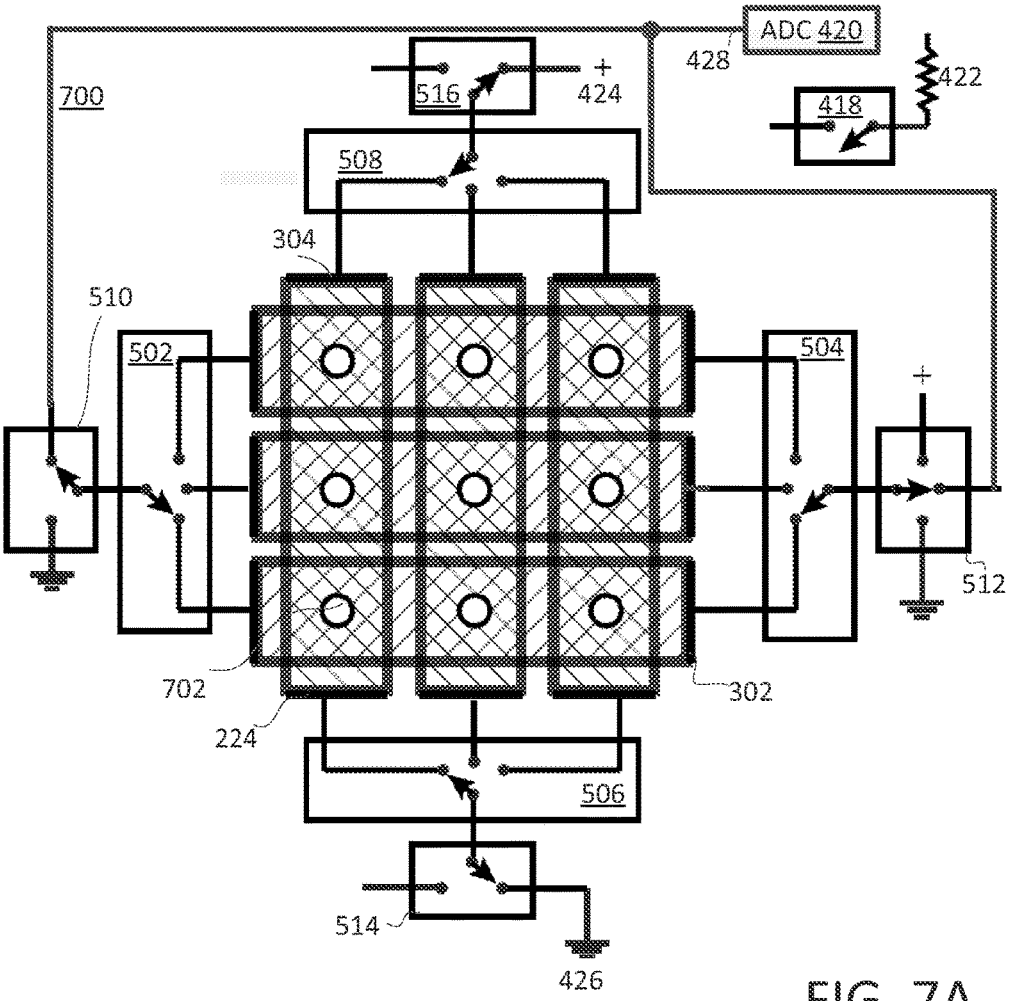
FIG. 7A is a schematic diagram showing switches in a y-axis configuration for the PMC of FIG. 1.

The y-axis read is analogous to the x-axis read, but rotated 90". In summary, to precisely determine the y position associated with a detected touch, the y-axis configuration 700 of FIG. 7A is used. Pull-up switch 418 is set so that the pull-up resistor 422 is decoupled from ADC input 428. The ends of the selected row FSP 302 are coupled to ADC input 428 by the left-row and right-row axis-select switches 510 and 512. Rear-column axis select switch 516 is set to couple the rear end of the selected column FSP 304 to power 424. The front-column axis select switch 514 is set to couple the front end of the selected column FSP 304 to ground 426.

Figure 7B:
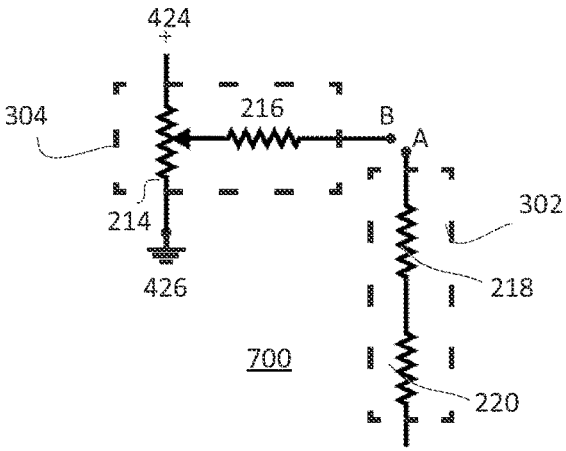
FIG. 7B is a circuit equivalent diagram for the y-axis configuration of FIG. 7A.

The resulting voltage divider configuration is shown in FIG. 7B. The voltage at the ADC input is the voltage at the point the selected column FSP 304 is contacted. This voltage can be used to determine the precise y position of the touch at the selected STZ. Thus, precise tracking of x-position, y-position and z-force is enabled by the use of the x-axis configuration, the y-axis configuration, and the z-axis configuration.

Row FSPs 302 and column FSPs 304 provide analog voltage outputs that respectively correspond to fine x-position along a row 120 and fine y-position along a column 122 (FIG. 1). ADC 420 is a 12-bit analog-to-digital converter that can distinguish 4096 voltages and, thus, positions along FSPs. There are eight STZs per column among which the 4096 positions must be partitioned. Thus, PMC 100 can distinguish 512 fine y-positions per STZ. There are twenty five STZs per row on the playing surface plus an additional STZ per row for buttons 128. This works out to about 160 x-positions that can be distinguished per the 19 mm x-extent of a cell. Over the surface of tactile membrane 114, over 15 million positions can be distinguished. To achieve a comparable level of tracking precision using capacitive or resistive multi-touch systems based on a high density of pressure sensing points only would be costly because of the requisite higher speed to read the high number of pressure points fast enough to achieve the low latency required for musical performance, as well as the increase computing power to compute the centroids of touch from the pressure points.

The power requirements for three-dimensional tracking are quite minimal. For the z-axis configuration 500 of FIGS. 5A and 5B, there is no current through the selected STZ unless a touch is detected. For the practical maximum of ten 10 touches, the at least 190 untouched STZs consume no power. For the x and y configurations 600 and 700 of FIGS. 6A, 6B and 7A, 7B, there is current and therefore power consumption whether or not the selected STZ is touched. However, by switching to these configurations only for STZs for which a touch is detected using the z configuration, power is consumed only for the touched STZs. No power is consumed for the purpose of detecting and tracking touches for vast majority STZs that are not touched at any given time.

For the vast majority of STZs that are untouched during any given scan, there is only one reading per scan. This keeps scan durations low and scan repetition rates high. This, in turn, provides high temporal resolution and more accuracy for tracking touch motion. Brute-force scanning alternatives require more processing power to achieve comparable temporal resolutions.

The described approach to scanning STZs is "hierarchical" in the sense that first gross (semitone) x and y position is determined as a function of the column and row of the STZ that is selected when a touch is detected. Then, only for the STZs for which a touch has been detected in the current scan, fine x and fine y position are determined.

Figure 8:
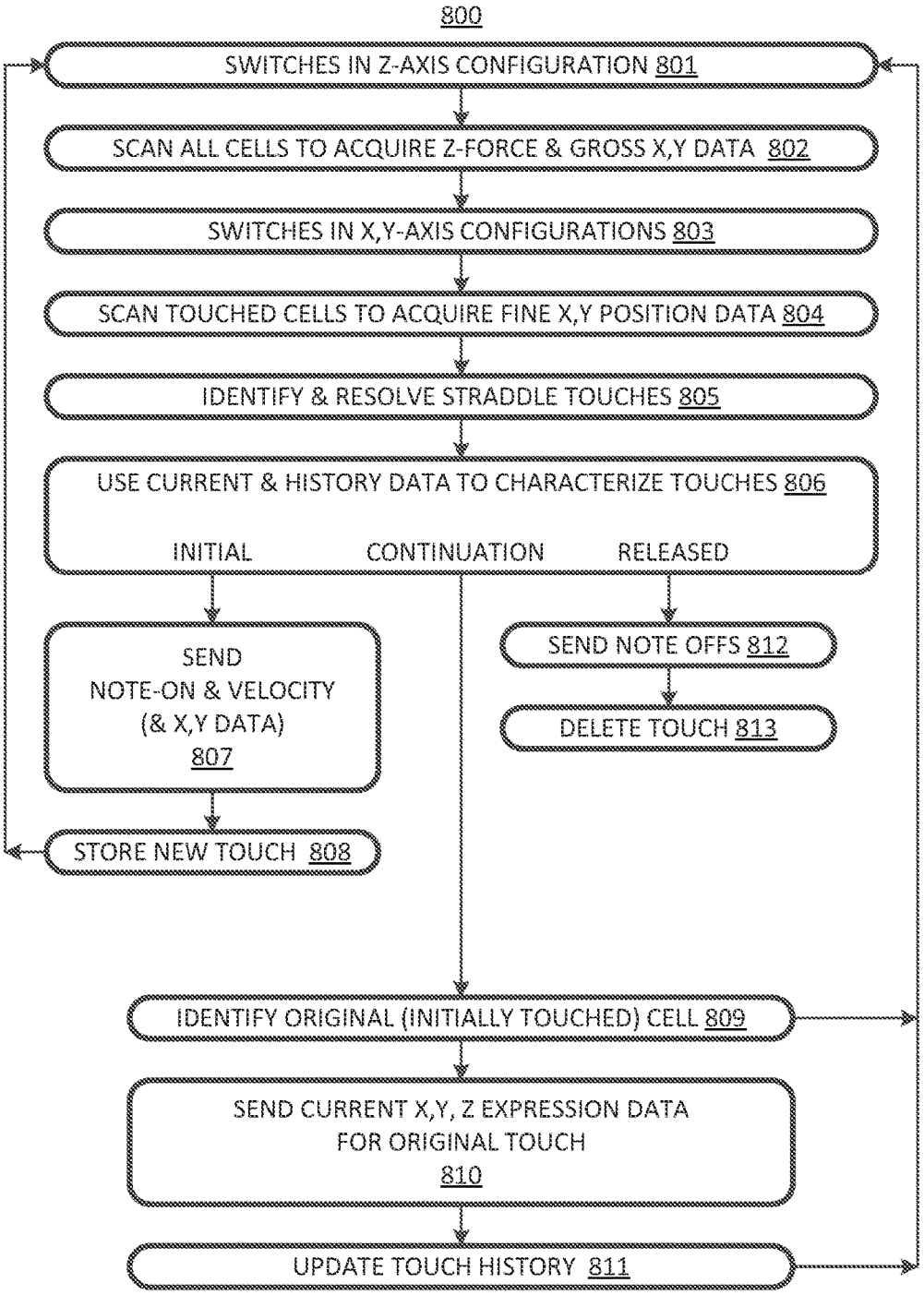
FIG. 8 is a flow chart of a process implementable by the PMC of FIG. 1 and by other controllers.

Hierarchical scanning is employed in a scanning process 800 of FIG. 8. At 801, axis-select switches 416 and ADC pull-up switch 418 are placed in the z-axis configuration if they are not already in it. At 802, all STZs are scanned to detect touches, acquire z-force readings, and, consequently, gross x, y data for detected touches. At 803, switches 416 and 418 are placed in the x-axis and y-axis configurations, at different times. At 804, fine x, y position data is obtained using the x-axis and y-axis configurations for and only for STZs for which touches have been detected. For any given STZ, action 803 occurs after action 802. However, actions 803 and 804 can take place as soon as a touch is detected, without waiting for the rest of the scan to be completed using the z configuration.

At 805, straddle touches are detected and resolved. A "straddle touch" is a touch that crosses a cell boundary so as to result in two or more detections for a single touch. Due to the presence of the ribs 308 of separator 208, inter-row straddles are infrequent. However, inter-column intra-row straddles are certainly possible. The challenge is to distinguish cases in which two adjacent detections result from two touches from those that result from a single straddle touch.

To distinguish an inter-column intra-row straddle touch from separate touches of adjacent cells, the fine x-position data can be used. For example, if the fine x-position data indicates that touch detections for adjacent cells are both very close to the same cell boundary, then the two detections may be interpreted as a straddle touch. In that case, one of the detections may be treated as the true detection; the other detection is then discarded. On the other hand, if at least one of the two fine x-positions is remote from the common cell boundary, then the detections may be considered separate. In that case, both touch detections result in updates to the touch history and result in music commands. An alternative embodiment uses a different spacer that allows inter-row straddles.

At 806, current and history data are used to characterize touches. A touch detection can represent an initial touch or a continuation touch. A continuation touch may be detected in the original STZ for the touch (same-cell touch) or a different STZ than the original touch, e.g., due to a slide. The scan rate is chosen such that tracking is effectively continuous, so that a touch slides at most to an adjacent cell between successive scans. Thus, a touch that resulted in a detection in the previous scan will, unless it has been released, appear during the current scan either in the same cell or an adjacent cell.

If a touch is identified as an initial touch, note-on and velocity data may be sent at 807. In some configurations, fine position data may be sent as well. For example, if initial position is configured to be "unquantized" initial fine position data may be sent, e.g., resulting in a non-zero pitch bend as the note is triggered. At 808, the new touch provides a new entry (touch ID, cell ID, x, y, z1, z2, z3 data) in touch history 404.

If the touch is identified as a continuation touch, the original cell at which the touch originally was detected is identified from the touch history at 809. At 810, expression data is sent in relation to the original note. At 811, the touch history is updated with the new x, y, and z expression data.

If no touch is detected for a cell that resulted in a touch the previous scan, it may be that the touch was released. In that case, a note off command may be sent at 812. In an alternative embodiment, a release velocity command may be sent along with the note-off command. Once a touch has been released, it can be deleted at 813 from the touch history. However, the lack of a touch in the same cell may be the result of a slide off the older cell. In the latter case, the fine x-positions of the previous and later touch will be close to the same inter-column boundary. Accordingly, fine position data may be used to distinguish a slide-off from a release.

FIG. 8 presents a logical (and not necessarily chronological) order of actions for a single STZ. There are a number of variations when the order of actions is considered on the scale of individual STZs. For example, a complete z-axis configuration scan 802 could be performed before any STZs are interrogated for fine x-position or fine y-position at 804. Alternatively, process 800 could be performed as far as possible for one STZ before process 800 is applied to the next STZ. In the latter case, some out of order actions might be required to resolve potential straddle touches and issues related to the ability to slide from STZ to STZ. Other orders of the actions of process 800 are implemented in other variations.

If the STZs are scanned sequentially left to right along a row, then the data for the STZ to the left will have been acquired by the time the data for the current STZ has been acquired. Therefore, data regarding the STZ to the left is available for interpreting the data for the current STZ. However, the data for the STZ to the right is acquired after the current STZ, so some interpretations of the current STZ data must wait until the data for the next STZ is collected.

Figure 9:
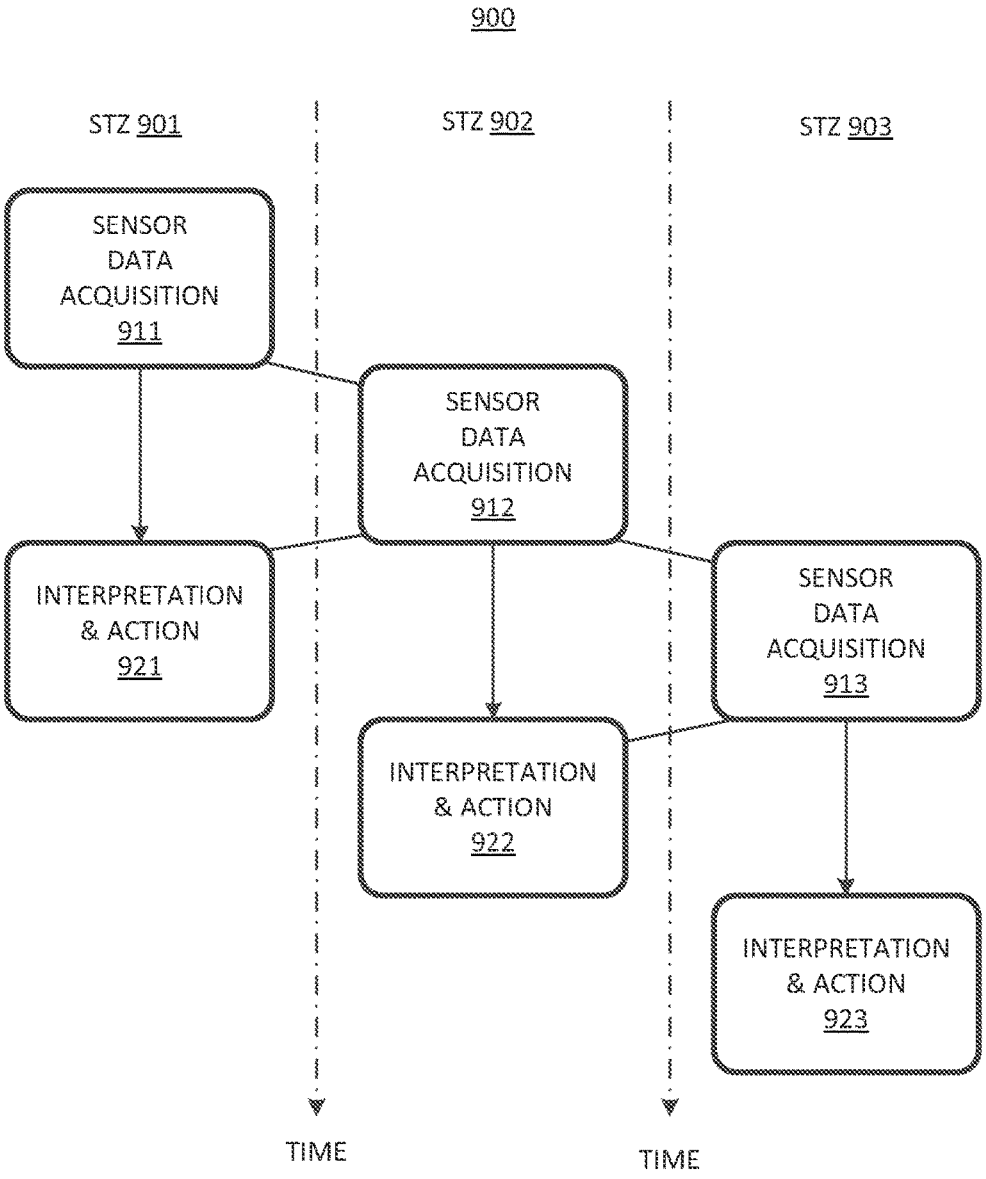
FIG. 9 is a flow chart indicating a scan order for the process of FIG. 8

Accordingly, a scan process 900 can be pipelined as shown in FIG. 9 for three consecutive STZs in a row, STZ 901, 902, and 903. At 911, sensor data is collected for STZ 901. This includes the z-axis data and, if a touch is detected, the fine-x and the fine y data. Next, sensor data is collected at 912 for STZ 902. Next, sensor data is collected for STZ 903 at 913.

Once sensor data has been collected at 912 for STZ 902, all the data required for interpreting the data collected at 911 for STZ 901 is available. Accordingly, interpretation of the sensor data for STZ 901 can be taken at 921, right after the sensor data for STZ 902 has been collected at 912. Any action to be taken based on the interpretation can proceed immediately after the interpretation. The interpretation at 921 can be concurrent with the sensor data acquisition 913 for STZ 903. Thus, interpretation and action 922 for STB 902 can occur after sensor data acquisition 913.

Once the sensor data for STZ 903 has been collected, the sensor data for STZ 902 can be interpreted and appropriate actions taken. If STZ 903 is not the end of a row, then interpretation at 923 must wait until the sensor data for the next STZ in the row is acquired. For the last STZ of a row, interpretation can proceed as soon as the respective sensor data is collected. In that case, sensor data collection can continue with the first STZ of the next row. Some interpretations are dependent. For example, if for STZ 901, it is determined that a touch has resulted from a leftward slide from STZ 902, then it can be assumed that a non-touch detection at STZ 902 is due to the same leftward slide.

As noted above, PMC 100 includes a circuit board 204 with an array 320 of multi-color LEDs. In PMC 100, these are arranged on a circuit board that is separate from the main circuit board. In an alternative embodiment, the LEDs are mounted on the main circuit board. For example, the LEDs can be bottom mounted to a main circuit board containing holes for the LED light to shine upward through the circuit board.

In PMC 100, the LEDs are arranged in an array 320 so that each LED 322 is aligned with a respective cell of tactile membrane 114. So that light emitted by the LEDs can reach tactile membrane 114, holes are formed in circuit board 202. Also, unprinted (or punched out) areas within the sensing layers serve as windows 702 (FIG. 7A) for light emitted by LEDs. Light reaching the translucent tactile membrane is diffused, to provide clearly visible bright spots to a performer. Each cell can be illuminated or not. Illumination can assume a variety of colors. In other words, tactile membrane 114 can be used as a 8-by-25-pixel multi-color display with finger-tip sized pixels. A performer can easily read the display without straining or squinting.

The display can be used for a variety of purposes. In-scale notes can be illuminated, while off-scale notes are not. In other words, the LED lighting can serve the function of the coloring of the black and white keys on a piano. However, unlike a piano, the illumination can be configured in different ways for different scales. Also, a different color can be used to indicate the "C" or other root note within each musical octave. The lights can also indicate configuration settings. For example, buttons 128 can provide access to configuration pages. The lights can indicate configuration settings, provide alphanumeric information, and graphical information (e.g., for volume levels and transpose settings). For many purposes, the performer need not refer to a computer screen or other display separate from the playing surface for configuring PMC 100.

While the importance of three-dimensional expression has been emphasized, there are also embodiments with two-dimensional expression. In two-dimensional embodiments, the dimension used to measure force is referred to as the "z-dimension" and the dimension along which fine position is measured is referred to as the "x dimension".

Relative to some multi-touch sensor PMCs, PMC 100 requires lower processing power due to the use of FSPs that define STZs; in part due to the lower processing power required, PMC 100 is more economical to manufacture than alternatives. In addition, PMC 100 integrates an informative and entertaining display into the playing surface, whereas other PMCs forego a display or require extra space for a separate display. One use of the display is to make finger positions clearly visible even in dim or dark conditions; other PMCs may be difficult to play in the absence of strong ambient light.

Relative to PMCs that use separate sensors for each note, PMC 100 uses a single multi-touch sensor to yield lower manufacturing costs. In addition, PMC 100 offers the ability to implement pitch slides such that the pitch that sounds intuitively matches the pitch of the note at the slide position. For example, a slide from an A up to a C is performed by sliding a finger from contact with a cell that triggered the A to a cell that, if triggered would trigger the C. This feature is not typically implemented where separate sensors are used for each note.

Relative to most other music performance controllers, PMC 100 offers the ability to control three axes of expression of a note using the same finger that triggered the note. This is not only intuitive, but makes it easy to perform the expression polyphonically. That is, three axes of expression can be controlled for each of plural concurrently played notes.

Other features include the availability of a large number, e.g., 200, note triggers in a lightweight compact form factor. The large number of note triggers provides for a wide note range and for note redundancy; note redundancy offers a performer choices in how to finger chords. In addition, chords can be transposed without changing the relative finger positions, unlike, for example, a piano-style controller for which a E major chord requires a different relative fingering than a C major chord.

Herein, a "music performance controller" is a device designed to control in real time a virtual, electronic, or other musical instrument based on a musician's performance gestures. Herein, a "polyphonic multi-dimensional controller" or "PMC" is a music performance controller with two or more axes of expression for two or more concurrently sounding notes.

Herein, a "force-sensing potentiometer" or "FSP" is a potentiometer or at least a resistance portion of a potentiometer that senses force. The FSPs disclosed herein sense force in a (z) dimension orthogonal to an (x or y) dimension along which position is measured using a voltage divider property of a potentiometer. The disclosed FSPs are constituted by printing force-sensing resistance strips on respective fixed resistance strips.

Herein, "single-touch zone" or "STZ" refers to a volume that can be used to detect a touch but that cannot spatially distinguish touches. Herein, a "cell" is the touchable surface or membrane of an STZ. In the illustrated embodiments, the cells and STZs are arranged in rows and columns.

Herein, a "music command" is a command that, according to a communications protocol, e.g., the MIDI protocol, is to be interpreted in a manner that affects music being output by a virtual, electronic, or acoustic musical instrument. Herein, a "dimension" is a direction in space. An "axis" is a direction through a point. Each axis defines a dimension that is shared by parallel axes. The "z" (spatial) dimension is the force dimension; if there are two other spatial dimensions, they are referred to as the "x" and "y" dimensions. If there is only one other dimension, it is referred to as the "x dimension".

Figure 10:
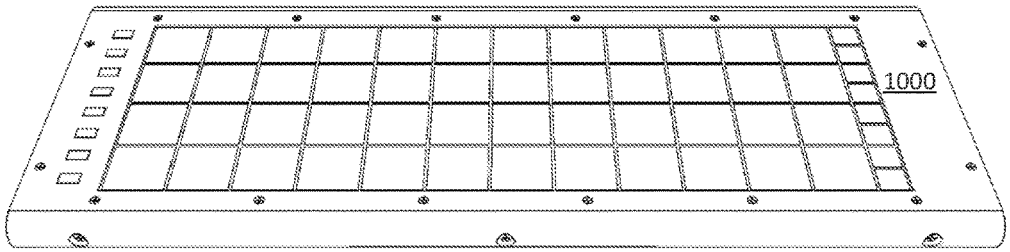
FIG. 10 is a perspective view of a PMC having large single-touch zones for use as drum pads.
Figure 11:
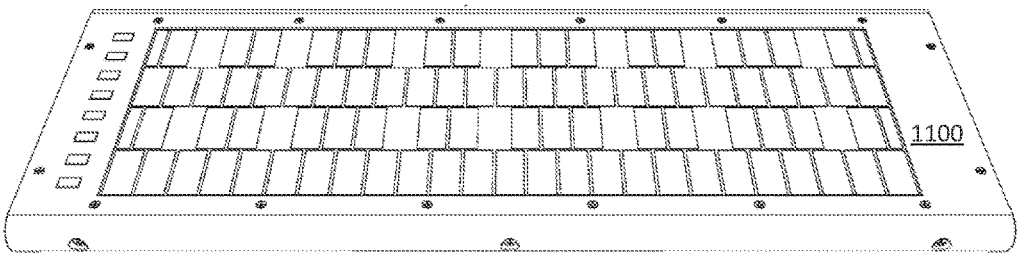
FIG. 11 is a perspective view of a PMC with single-touch zones laid out in a piano-key arrangement with an upper keyboard and lower keyboard.
Figure 12:
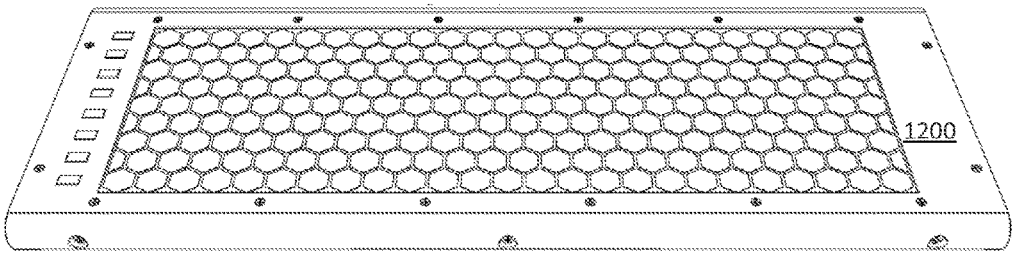
FIG. 12 is a perspective view of a PMC with hexagonal single-touch zones laid out in a hexagonal array.
Figure 13:
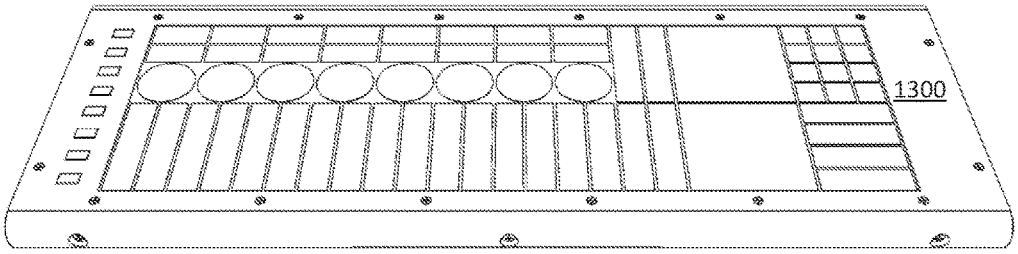
FIG. 13 is a perspective view of a PMC with single-touch zones of various shapes.

The present invention provides for a wide variety of physical configurations. For example, the number of rows and columns of cells and STZs can vary from embodiment to embodiment. Also, the rows and columns need not be orthogonal to each other. Also, various sizes, shapes, and arrangements can be used. For example, PMC 1000, FIG. 10, has large cells suitable for use as drum pads. PMC 1100, FIG. 11, has cells arranged in a piano-like arrangement. PMC 1200, FIG. 12, has hexagonal cells arranged in a hexagonal array; in such a hexagonal array, the vertices of the hexagons can correspond to major and minor chords. PMC 1300, FIG. 13, has a variety of cell shapes and sizes, e.g., for use as a general-purpose controller. These and other variations upon and modifications to PMC 100 are provided for by the present invention, the scope of which is defined by the following claims.

What is claimed is:

1. A polyphonic multi-dimensional controller (PMC) comprising:

a first sensing layer with row force-sensing potentiometers (FSPs) extending in an x dimension;

a second sensing layer with column force-sensing potentiometers extending in a y-dimension such that each pair of a row FSP and a column FSP defines a single-touch zone (STZ) that intersects the row FSP and intersects the column FSP;

a spacer for spacing the first and second sensing layers so as to prevent, in the absence of a touch causing the sensing layers to connect physically and electrically, a current between the first sensing layer and the second sensing layer;

analog switches for selecting STZs, the analog switches having, a z-axis configuration for establishing a current between the first sensing layer and the second sensing layer to permit detections of touches at respective selected STZs, and determinations of forces of respective detected touches at selected touch zones; and an x-axis configuration for determining fine x-positions within touched STZs by detecting voltages at the FSPs, and a processor programmed to control the analog switches and to output music commands as a function of touch detections, force determinations, and fine x-position determinations.

2. The PMC of claim 1 wherein the analog switches further provide a y-configuration for determining fine y-positions within touched STZs by detecting voltages at respective FSPs.

3. The PMC of claim 2 wherein the processor is further programmed to cause the analog switches to enter the x-axis configuration and the y-axis configuration only when a most-recent z-axis configuration resulted in a z-force indicating that the currently selected STZ is being touched.

4. The PMC of claim 2 further comprising media encoded with a touch history for storing previous x-positions, y-positions, and z-force values.

5. The PMC of claim 4 wherein the processor is further programmed:

to distinguish a new touch from a continuation touch in part using data stored in the touch history; and to add a new touch to the history if the touch is a new touch, and to update an existing touch in the history if the touch is a continuation.

6. The PMC of claim 5 wherein the processor is further programmed to:

associate fine-x-position, fine y-position, and z-force values read while a first STZ is selected by the analog switches not with the first STZ but rather with a second STZ different from the first STZ, the association to the second STZ being based in part on data stored in the touch history; and send music commands updating expression data for a note associated with the second STZ rather than a note associated with the first touch zone.

7. The PMC of claim 4 wherein the processor is further programmed to:

distinguish non-touch releases from non-touch continuations using data from the history; and send a note-off command in response to a non-touch release but not in response to a non-touch continuation.

8. The PMC of claim 2 further wherein the x-axis configuration, the y-axis configuration, and the z-axis configuration are mutually exclusive in that the analog switches can assume at most one of them at a time.

9. A process comprising:

causing analog switches to be in a z-configuration such that a z-force value for a selected touch zone (STZ) defined by force-sensing potentiometers (FSPs) can be measured using the FSPs;

scanning an array of touch zones using the z-configuration to determine, using the FSPs, which STZs are being touched and which STZs are not being touched;

for STZs that are being touched, using the FSPs to determine respective z-force values while the analog switches are in the z-configuration; and for STZs that are being touched, causing the analog switches to be in an x-configuration to determine, using the FSPs, fine x-positions for respective STZs.

10. The process of claim 9 further comprising: for STZs that are being touched, causing the analog switches to be in a y-configuration to determine, using the FSPs, a fine y-position for a selected touched STZ.

11. The process of claim 10 wherein unless a touch is detected for a currently-selected STZ, the x configuration and the y configuration are not entered for the currently-selected STZ.

12. The process of claim 10 further comprising, for each detected touch, storing an x-position value, a y-position value, and a z-force value in association with a respective current STZ identifier and a respective original STZ identifier.

13. The process of claim 10 wherein the FSPs include:

row FSPs extending in a x-direction for use in determining fine x-position;

column FSPs extending in a y-direction for use in determining fine y-position;

wherein each STZ intersects a respective row FSP and a respective column FSP.

14. A system comprising non-transitory media encoded with code that, when executed by a hardware, causes the hardware to implement the process of claim 10.

* * * * *